US006397917B1

(12) United States Patent
Levert

(10) Patent No.: US 6,397,917 B1
(45) **Date of Patent: *Jun. 4, 2002**

(54) COMBINED MULTIPLE-GLAZED WINDOW AND LIGHT-CONTROL ASSEMBLY

(75) Inventor: Robert Jan Levert, Capelle a/d IJssel (NL)

(73) Assignee: Hunter Douglas Industries B.V., El Rotterdam (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/590,048

(22) Filed: Jun. 8, 2000

Related U.S. Application Data

(63) Continuation of application No. 09/141,494, filed on Aug. 27, 1997, now Pat. No. 6,123,137.

(30) Foreign Application Priority Data

Aug. 28, 1997 (EP) ..... 97202627

(51) Int. Cl.[7] ..... A47H 1/00
(52) U.S. Cl. ..... 160/107; 160/113; 160/115; 160/168.1
(58) Field of Search ..... 160/98, 107, 115, 160/166 R, 168 R, 172, 176.1 R, 178 R, 176.1, 174, 310, 387, DIG. 17; 49/64, 92.1

(56) References Cited

U.S. PATENT DOCUMENTS 168,221 A 9/1875 Bryan
2,146,816 A 2/1939 Grassby, Jr.
2,155,985 A 4/1939 Waterman (List continued on next page.)

FOREIGN PATENT DOCUMENTS

| | | |
|---|---|---|
| AT | 370205 | 3/1983 |
| DE | 4117146 | 11/1992 |
| DE | 19632684 | 2/1998 |
| EP | 060788 | 9/1982 |
| EP | 303107 | 2/1989 |
| EP | 0524388 | 1/1993 |
| EP | 566524 | 10/1993 |
| EP | 606543 | 7/1994 |
| GB | 1536600 | 12/1978 |
| GB | 2162226 | 1/1986 |
| GB | 2169946 | 7/1986 |
| JP | 2-5875 | 2/1990 |
| JP | 2-15976 | 4/1990 |

*Primary Examiner*—Bruce A. Lev
(74) *Attorney, Agent, or Firm*—Dorsey & Whitney LLP

(57) ABSTRACT

A double-pane window having a light-control assembly within its peripheral frame. The light-control assembly has an upper section which is adapted to redirect light entering the window through the outside pane so that the light, exiting the window through the inside pane, is reflected upwardly against a ceiling surface of the interior of a room, on the wall of which the window is mounted; and a lower section which is adapted to inhibit light entering the window through the outside pane from exiting the window through the inside pane. The lower section and optionally the upper section can each comprise a plurality of laterally-extending slats which can be pivoted about their laterally-extending axes to inhibit or redirect light entering the window. If desired, the slats of the lower section can be pivoted independently of the slats of the upper section. The slats of at least the upper section preferably have a transverse cross-section with a concave surface facing upwardly. It is also advantageous that the upper surface of these slats be highly reflective, and these slats can also be perforated or partially translucent.

16 Claims, 3 Drawing Sheets

U.S. PATENT DOCUMENTS

| | | | | | |
|---|---|---|---|---|---|
| 2,209,355 | A | | 7/1940 | Schmitz | |
| 2,300,545 | A | | 11/1942 | Gouch | |
| 2,373,762 | A | | 4/1945 | Krehbiel | |
| 2,459,517 | A | | 1/1949 | Gearhart | |
| 2,570,199 | A | | 10/1951 | Brown | |
| 2,579,485 | A | | 12/1951 | Ferguson et al. | |
| 2,620,869 | A | | 12/1952 | Friedman | |
| 2,749,581 | A | | 6/1956 | McCormick | |
| 2,836,237 | A | | 5/1958 | Hogin et al. | |
| 2,979,127 | A | | 4/1961 | Brown | |
| 4,076,068 | A | | 2/1978 | Archer et al. | |
| 4,459,778 | A | | 7/1984 | Ball | |
| 4,513,804 | A | * | 4/1985 | Anderson | 160/174 |
| 4,577,619 | A | | 3/1986 | Howe, Jr. | |
| 4,588,012 | A | | 5/1986 | Anderson | |
| 4,621,672 | A | * | 11/1986 | Hsu | 160/115 |
| 4,664,169 | A | | 5/1987 | Osaka et al. | |
| 4,702,296 | A | | 10/1987 | Anderson | |
| 4,723,586 | A | | 2/1988 | Spangenberg | |
| 4,768,576 | A | | 9/1988 | Anderson | |
| 4,884,613 | A | | 12/1989 | Komori et al. | |
| 4,979,552 | A | | 12/1990 | van der Zanden | |
| 5,081,402 | A | | 1/1992 | Koleda | |
| 5,119,868 | A | | 6/1992 | Werner | |
| 5,205,335 | A | | 4/1993 | Horton et al. | |
| 5,226,466 | A | | 7/1993 | Coddens | |
| 5,388,000 | A | | 2/1995 | Bartenbach | |
| 5,391,967 | A | | 2/1995 | Domel et al. | |
| 5,414,334 | A | | 5/1995 | Cheron | |
| 6,015,001 | A | * | 1/2000 | Tronsgard et al. | 160/115 |
| 6,070,638 | A | * | 6/2000 | Jelic | 160/107 |
| 6,076,587 | A | * | 6/2000 | Pastor | 160/115 |
| 6,123,137 | A | * | 9/2000 | Levert | 160/107 |
| 6,196,292 | B1 | * | 3/2001 | Jackson | 160/113 |
| 6,227,279 | B1 | * | 5/2001 | Belongia et al. | 160/115 |

* cited by examiner

COMBINED MULTIPLE-GLAZED WINDOW AND LIGHT-CONTROL ASSEMBLY

CROSS-REFERENCE TO RELATED APPLICATIONS

This application is a continuation of U.S. utility application Ser. No. 09/141,494, filed Aug. 27, 1998 (the '494 application), now U.S. Pat. No. 6,123,137, issued Sep. 26, 2000. The '494 application corresponds to and claims priority to European Application No. 97202627.2, filed Aug. 28, 1997. The '494 application and the corresponding European application are hereby incorporated by reference as though fully set forth herein.

BACKGROUND OF THE INVENTION a. Field of the Invention

This invention relates to a multiple-glazed window containing an integral assembly for controlling the amount of daylight passing though the window into a room. In particular, the invention relates to a window having a peripheral frame enclosing inside and outside glass panes that are substantially parallel and define a space between them which is preferably sealed and in which the light-control assembly is mounted.

b. Background Art

Double-pane windows containing motorized venetian blinds as light-control assemblies have been described in U.S. Pat. Nos. 4,723,586 and 4,979,552. Such windows have satisfied most light-control requirements. In addition, the mere positioning of a venetian blind within the space between two glass panes in a window has long been known to reduce heat losses by radiation through the window to an extent approaching those of windows with triple panes.

Notwithstanding this, the increased use of computer monitors in office buildings has presented additional demands on windows and their associated light-control assemblies for providing protection against the glare from sunlight, without totally eliminating daylight illumination within such buildings. Blocking such glare by closing the window blinds has often diminished the level of illumination in offices below acceptable limits, but increasing the use of artificial illumination, such as electric lighting, has also been objectionable from an environmental point of view.

Anti-glare venetian blinds have also been previously described. For example, in European patent 0,303,107, an anti-glare venetian blind is provided with slats: which are upwardly concave, which have their inner longitudinal edges (facing towards the room) as high or higher than their outer longitudinal edges (facing away from the room), which are mirrored on at least their topsides and retro-reflecting on their undersides, and the spacing and position of which are so selected that the light passes through them mostly into an angular region above the horizon. In European patent application 0,606,543, an anti-glare blind is provided with slats which are: upwardly concave, mirrored on their topsides and at least partially perforated. Although these blinds appear to be able to guide light towards the ceiling of a room and avoid glare, they are not adapted to allow some sunlight to enter the rest of a room. In this regard, it would be desirable, on sunny days, to be able to block or inhibit heat and glare from entering the rest of the room, without blocking daylight illumination entirely from the rest of the room.

BRIEF SUMMARY OF THE INVENTION

For this reason, there has been a continuing interest in eliminating glare and sunlight from the lower portions of office windows while redirecting light from the upper portions of office windows within offices. It is therefore an object of this invention to provide an improved multiple-glazed window with an integral light-control assembly.

In accordance with this invention, a double-pane window is provided, containing, within a peripheral frame, a light-control assembly that includes:

i) an upper section which is adapted to redirect light entering the window through the outside pane so that the light exits the window through the inside pane; and ii) a lower section which is adapted to reduce or eliminate light entering the window through the outside pane from exiting the window through the inside pane. Preferably, the light passing through the upper section of the window can be reflected upwardly, against a ceiling surface of the interior of a room, to provide additional illumination. In the lower section of the window, sunlight and glare from the outside, which might otherwise disturb the occupants of the room, can be substantially reduced or eliminated as desired without losing altogether the benefits of daylight illumination.

Advantageously the upper and lower sections each comprise a venetian blind assembly provided with a plurality of substantially parallel laterally-extending elongate slats, the slats of at least the lower section being pivotable about their laterally-extending axes. Such an assembly allows the use of standard components from existing double-pane windows containing enclosed venetian blinds such as are disclosed in U.S. Pat. No. 4,723,586.

Desirably, the lower section of the light-control assembly is adjustable independently of the upper section. This permits the assembly to be used to optimize light control under different conditions.

The slats of at least the upper section of the light-control assembly preferably have a highly reflective upper surface for improved control of daylight which these slats redirect through the window. For the same purpose and advantageously in combination therewith, the slats of at least the upper section can be perforated or partly translucent.

Further enhancement of light distribution with the window of the invention can be obtained by giving the slats of the upper section a cross-section, as taken transversely (i.e., from the outside to the inside of the window), that includes a concave surface facing upwardly. In certain embodiments of the invention, each of the upwardly concave slats of the upper section preferably has a mirrored top surface and a retro-reflective bottom surface. In other embodiments, the upwardly concave slats of the upper section preferably have a mirrored top surface and are wholly or partially perforated.

In addition, heat losses by radiation through the window of this invention, particularly in the winter, can be further substantially reduced by providing the surface on the inside- and/or outside-facing surfaces of preferably all of the slats with an emission coefficient lower than 0.5, and preferably lower than 0.3, for radiation with a wavelength larger than 1.5 micrometer. In this regard, advantageous are aluminium slats coated with a very thin zinc chromate layer, such as are described in British patent 1,536,600.

Although each slat of the light-control assembly in accordance with this invention can be individually suspended from pivots on laterally opposite sides of the window frame, it is preferred that the slats be tiltably suspended from laterally-spaced tilt cords. In this regard, the slats of the lower section of the light control assembly may be tiltably suspended from laterally-spaced tilt cords and the slats of the upper section be non-tiltably fixed in a position re-directing light upwardly towards the ceiling of the room.

Preferably an electric motor is used to adjust at least the slats of the lower section of the light-control assembly. A suitable electric motor is described in U.S. Pat. No. 4,979,552 and is preferably hermetically sealed in the space between the windowpanes. The use of such an electric motor is particularly advantageous when movement of the light-control assembly is to be adjusted with a microprocessor control so as to allow optimal light regulation under varying conditions without requiring the intervention of the room occupants.

In one embodiment of this invention, the top of the lower section is suspended from a laterally-extending intermediate bar, beneath the upper section. Such an arrangement allows an increased number of existing components of known double-pane windows containing venetian blinds to be used and also allows the upper and lower sections to be mounted in the window in essentially the same manner. Advantageously, the intermediate bar is suspended only at its lateral edges from laterally opposite sides of the frame, using a T-shaped connector at one lateral edge and an electric motor for the lower section as a connector at the other lateral edge.

The window of the invention is substantially vertical. Normally it will be truly vertical but it may be mounted in a slanted position in which case the plane of its light-control assembly is advantageously positioned closer to the upper glass pane of the window, as so mounted. In this regard, it is especially advantageous that the attachment of the upper and lower sections of the light-control assembly to the intermediate bar be positioned closer to the upper glass pane to compensate for any sagging of the light-control assembly within the slanted window, and it is particularly advantageous that the upper end of the upper section and the lower end of the lower section also be positioned closer to the upper glass pane to compensate for any sagging of the light-control assembly within the slanted window.

BRIEF DESCRIPTION OF THE DRAWINGS

Preferred embodiments of the sealed double-pane window with a light-control assembly of this invention will now be described in more detail with reference to the accompanying drawings in which.

DESCRIPTION OF THE PREFERRED EMBODIMENTS

Figure 1:
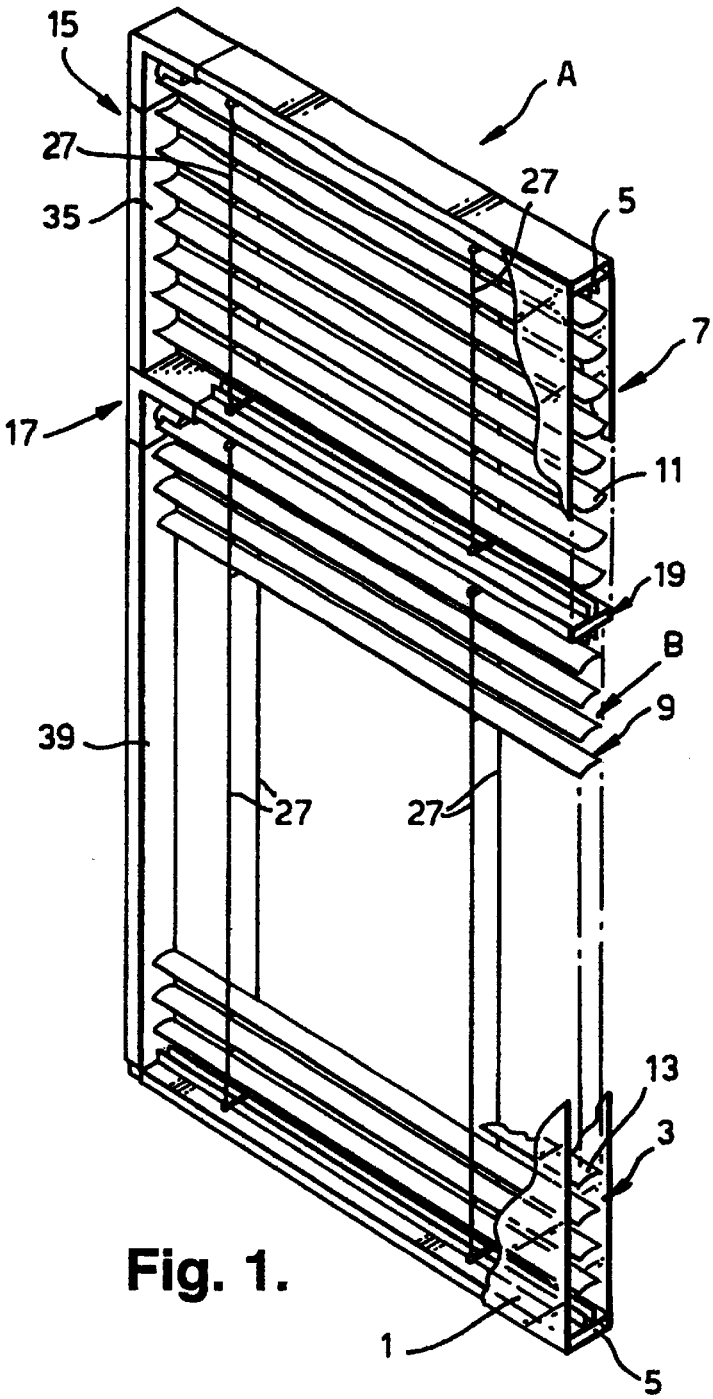
FIG. 1 is a schematic perspective view of a double-glazed window, shown partly in section, containing a light-control assembly according to the invention.
Figure 2:
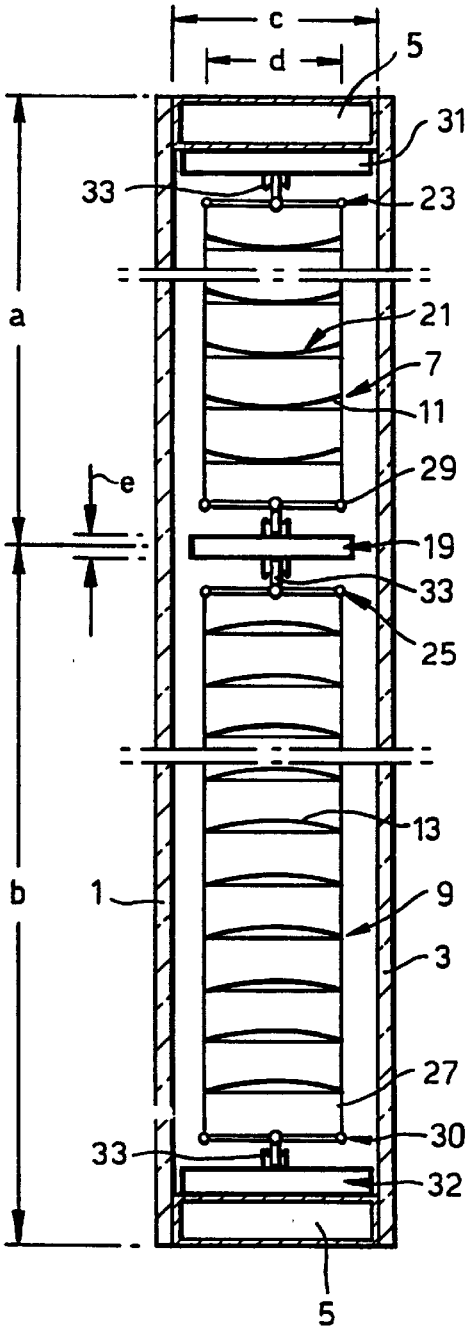
FIG. 2 is a vertical sectional view of the window of FIG. 1, showing in more detail the light-control assembly and its mounting within the window.

Schematically shown in FIGS. 1 and 2 is one embodiment of a substantially vertical, hermetically sealed, double-pane window of this invention, generally indicated by reference A. The window A is provided with a light-control assembly, generally indicated by reference B, that is mounted in the space between the two glass panes 1 and 3 of the window. The first or outside pane of glass 1 and the second or inside pane of glass 3 are positioned on opposite sides of a rectangular peripheral, plastic or metal (e.g., aluminum) frame 5 of the window A.

The glass panes 1 and 3 and the frame 5 are adhered together by a suitable sealing compound, such as is conventional in making hermetically sealed, multiple-glazed windows.

The light-control assembly B, mounted between the glass panes 1 and 3 and within the frame 5 of the window A of FIGS. 1 and 2, has an upper section 7 and a lower section 9. Each section 7 and 9 comprises an array of parallel elongate slats 11 and 13 respectively, that are substantially horizontal and laterally-extending and can be pivoted or tilted about their laterally-extending axes. In alternative embodiments of the assembly B, the slats 13 of the lower section 9 can be pivoted or tilted about their laterally-extending axes while the slats 11 of the upper section are non-tiltably fixed in a position allowing the light to be guided towards the ceiling. Preferably, the upper section 7 occupies less of the area of the window A than does the lower section 9.

The slats 11 and 13 each have a curved cross-section when viewed parallel to the panes of the window A. The slats 11 in the upper section 7 have their concave surfaces facing generally upwardly, and the slats 13 in the lower section 9 have their convex surfaces facing generally upwardly. Each section 7 and 9 of the light-control assembly B is provided with its own motor drive 15 and 17, respectively, for tilting its slats. Of course, if the slats 11 of the upper section 7 are non-tiltably installed in the window, its motor drive 15 can be omitted.

The first motor 15 for tilting the slats 11 of the upper section 7 is mounted in the peripheral frame 5 as described in U.S. Pat. No. 4,979,552.

The second motor 17 for tilting the slats 13 of the lower section 9 is connected to a lateral edge of a substantially horizontal laterally-extending elongate intermediate bar 19 which separates the upper section 7 from the lower section 9 of the light-control assembly B of the double-pane window A.

The use of separate motors 15 and 17, together with a suitable control for activating the motors individually, permits the slats 11 and 13 of the upper and lower sections to be tilted separately and independently. The use of a microprocessor as a control for the motors would permit the slats of the light-control assembly B to pivot automatically in response to changing light conditions in the room(s), in the walls of which the window is mounted, or in response to other parameters, such as time.

As a result of this arrangement, daylight can be reflected from the outside by the slats 11 of the upper section 7 of the window A on to a ceiling surface of a room to compensate for the light blocked out, for glare protection, by the slats 13 of the lower section 9 of the window.

A suitable proportion of light protection and light redirection can be obtained for many windows of office buildings and the like if the upper section 7 extends over roughly one-third of the height of the window A as indicated by "a" in FIG. 2 and the lower section 9 extends over roughly two-thirds thereof as indicated by "b" in FIG. 2.

Figure 1A:
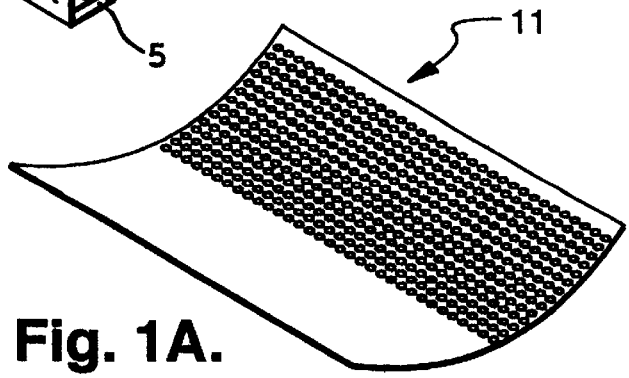
FIG. 1A is an enlarged view of a length of a slat from the upper section according to one alternative embodiment.

The light distribution effects of the upper section 7 of the light-control assembly B can be further improved by positioning its slats 11 with their upwardly concave surfaces 21 facing general vertically upward and additionally by providing these concave surfaces 21, with highly reflective properties. In this regard, top surfaces of these slats can be mirrored as described in EP 0,303,107. The bottom surfaces of these slats 11 can likewise be provided with retro-reflective properties as described in EP 0,303,107 or instead, the slats 11 can be wholly or partially perforated as described in EP 0,606,543 and shown in FIG. 1A.

As seen in FIG. 2, the upper ends of both the upper and lower blind sections 7 and 9 of the light-control assembly B of this invention are pivotally suspended from respective transversely-extending tilt bars 23 and 25 by means of parallel ladder strings 27, the upper ends of which are attached to the transverse edges of the tilt bars. The lower end of each blind section 7 and 9 carries a transversely-extending terminal slat 29 and 30 respectively, which preferably is identical to the upper tilt bars 23 and 25. The lower ends of the parallel ladder strings 27 are attached to the transverse edges of the terminal slats 29 and 30. The upper tilt bar 23 and the lower terminal slat 30 are pivotally connected to conventional, horizontali upper and lower carriers or glass spacers 31 and 32 respectively, which are mounted within the frame 5, on its top and bottom respectively. The lower tilt bar 25 and the upper terminal slat 29 are pivotally connected to the bottom and top of the intermediate bar 19.

The tilt bars 23 and 25 and terminal slats 29 and 30 can be pivotally connected to their respective spacers 31 and 32 and intermediate bar 19 in a conventional manner. Preferably, these elements are connected in the manner described in U.S. Pat. No. 4,723,586, using detent grooves (not shown) in the top and bottom of the spacers 31 and 32 and the intermediate bar 19 and using hanger pivots 33 mounted in the grooves and pivotally connected to the respective tilt bars and terminal slats.

The transverse spacing "c" in FIG. 2 between the panes of glass 1 and 3 is a function of the thickness of the peripheral frame 5, including its spacers 31 and 32. The transverse spacing "c" must accommodate the transverse thickness "d" of the blind slats 11 and 13 and the transverse thickness of the spacers 31 and 32 as shown in FIG. 2. In sealed glass blind units as described in U.S. Pat. No. 4,979,552, it is not uncommon for such spacers to have a transverse width of only about 22 millimeters and for the blind slats to have a transverse width of only about 12 to 16 millimeters.

With such reduced dimensions of the slats 11 and 13 in accordance with this invention, as compared to the dimensions of conventional venetian blinds, the intermediate bar 19 should be as unobtrusive as possible, and its height "e" as shown in FIG. 2 should be about the same as the vertical spacing between adjacent slats 11 and 13. At the same time, the intermediate bar 19 should be sturdy enough to carry the weight of the bottom section 9 of the light control assembly B.

If desired, the transverse edges of the intermediate bar 19 can be mounted on the opposed inner surfaces of the glass panes 1 and 3 in a manner similar to that used for mounting the spacers 31 and 32 on the frame 5. The sealing compound used to bond and seal the frame 5 and glass panes 1 and 3 together could also be used for this purpose. However, it is possible that the intermediate bar 19 to be free of attachment to the inner surfaces of the glass panes 1 and 3, and, in particular, for the intermediate bar 19 to be free-floating relative to the panes 1 and 3. Alternatively, the intermediate bar 19 could be suspended from the terminal slat 29 of the upper section 7 of the light control assembly B, and if desired, the motor 17 for driving the slats 13 of the lower section 9 could also be free-hanging with the intermediate bar 19 within the window A of this invention.

Figure 3:
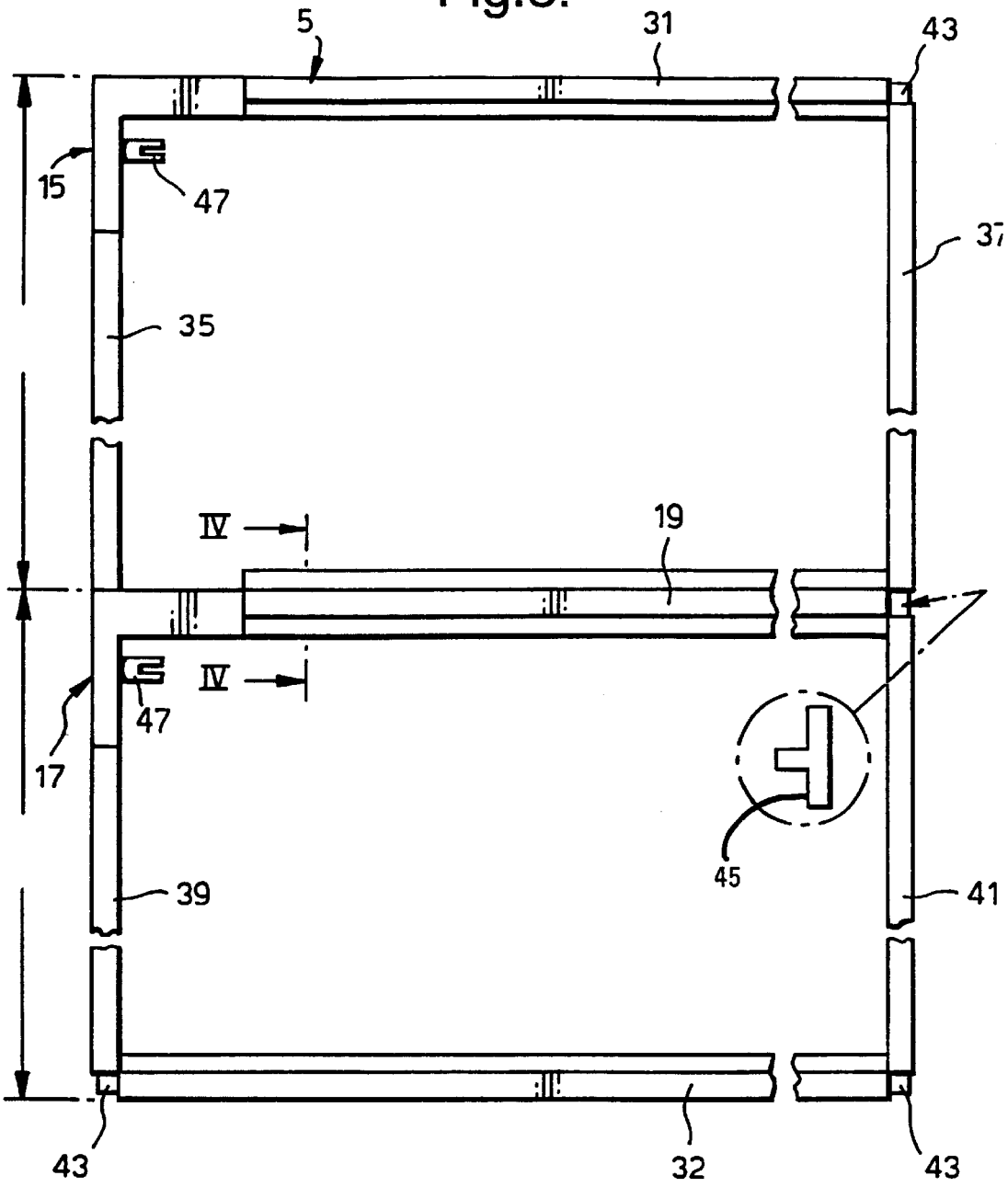
FIG. 3 is a front elevation view showing an assembled peripheral frame for the window of FIG. 2 prior to fitting the light-control assembly within the frame.

However, it is preferred to suspend the intermediate bar 19, as shown schematically in FIG. 3, from laterally opposite sides of the frame 5 so as not to put too much strain on the ladder cords 27 or tilt cords (not shown) or on the supporting components of the upper section 7 of the light control assembly B. To this end, laterally opposite sides of the frame 5 are provided with vertical frame members 35, 37, 39 and 41, two of the frame members 35 and 37 being located above the intermediate bar 19, the other two frame members 39 and 41 being located below the intermediate bar 19, and an upper frame member 35 and a lower frame member 39 being located on opposite lateral sides of the frame from the other upper and lower frame members 37 and 41 respectively. The motor 15 for the upper section 7 of the light-control assembly B is connected to both the upper spacer 31 and the top of the left upper vertical frame member 35, thereby forming the left upper corner of the frame. The other motor 17 for the lower section 9 of the light-control assembly B is connected to the bottom of the left upper vertical frame member 35, as well as to the top of the lower left vertical frame member 39. The remaining three corners of the frame are connected by L-shaped comer connectors 43.

The intermediate bar 19 is connected to the right upper and lower frame members 37 and 41 by a T-shaped connector 45 which is separately shown to an enlarged scale in an insert to FIG. 3. The T-shaped connector is adapted to be inserted into the bottom of the upper frame member 37, into the top of the lower frame member 41 and into a lateral side of the intermediate bar 19.

As shown in FIG. 3, the motors 15 and 17 each have a laterally-protruding, slotted shaft 47. Each of these shafts 47 is adapted to engage a lateral edge of one of the tilt bars 23 and 25 of the upper and lower sections 7 and 9 of the light-control assembly B of the window A of this invention as shown in FIG. 2. As described in U.S. Pat. No. 4,979,552, electrical conduits (not shown) pass through the frame, preferably in a sealed manner, and are connected to the motors 15 and 17 to power them.

Figure 4:
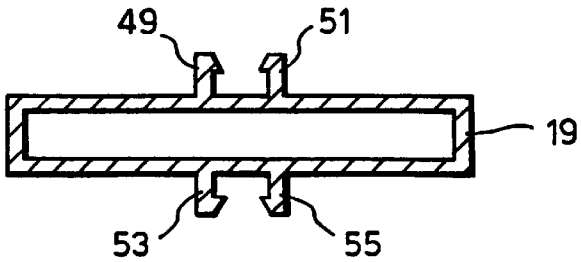
FIG. 4 is a transverse cross-sectional view, taken along line IV—IV in FIG. 3, showing one embodiment of the intermediate bar of the light-control assembly.

A cross-section of the intermediate bar 19 is shown in FIG. 4. Upwardly extending, hanger attachment flanges 49 and 51 define an undercut detent groove between them on the upper side of the intermediate bar 19. Similar detent grooves are also provided between the downwardly extending, hanger attachment flanges 53 and 55 on the lower side of the intermediate bar 19. The pivot hangers 33, such as are described in U.S. Pat. No. 4,723,586, are engaged in such grooves and are connected to the tilt bars 23 and 25 and the terminal slats 29 and 30.

If a double-pane window A as shown in FIGS. 1–4 were to be mounted in an inclined position, as is sometimes required from an architectural point of view, there would be a tendency for its slats 11 and 13 to hang against the lower pane of glass.

Figure 5:
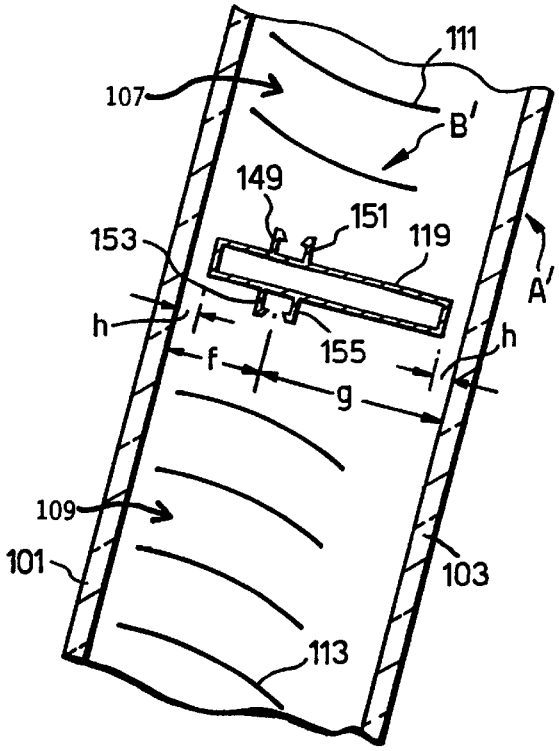
FIG. 5 is partial vertical cross-sectional view, of an alternative embodiment of the window of the invention.

Such an arrangement is shown in FIG. 5.

In the following description, corresponding parts of the alternative embodiment of the invention shown in FIG. 5 are referred to by reference numerals which differ by "100" from those of the embodiment shown in FIGS. 1–4.

FIG. 5 shows an inclined sealed double-pane window, generally A', with a light-control assembly B' of this invention having a modified intermediate bar 119.

In the window A' of FIG. 5, the tendency for the slats 111 and 113 to sag and, as a result, to hang against the lower pane 103 of glass is compensated for by displacing the hanger attachment flanges 149, 151, 153 and 155 on the top and bottom of the intermediate bar 119 toward the upper pane 101. This results in there being unequal distances "f" and "g" in FIG. 5 between i) the pivot points of the blind sections 107 and 109 with the intermediate bar 119 and ii) the panes 101 and 103. Preferably, the hangers (not shown in FIG. 5) on the tilt bar (also not shown in FIG. 5) at the upper end of the upper section 107 and on the terminal slat (also not shown in FIG. 5) at the lower end of the lower section 109 also are mounted on their respective upper and lower spacers closer to the upper glass pane 101 to compensate further for any sagging of the light-control assembly B'within the slanted window A'. However, the transverse spacing "h" in FIG. 5 of the intermediate bar 119 from the upper and lower panes 101 and 103 is preferably kept equal, so that the intermediate bar can be connected to the vertical frame members (not shown) in the same manner as is described in relation to FIG. 3.

This invention is, of course, not limited to the above-described embodiments of FIGS. 1–5, which may be modified without departing from the scope of the invention or sacrificing all of its advantages. In this regard, the terms in the foregoing description, such as "left", "right", "lateral", "bottom", "top", "transverse", "upper"and "lower", have been used only as relative terms to describe the relationships of the various elements of the combined multiple-glazed window and light-control assembly of the invention.

What is claimed is:

1. A substantially vertical, double-pane window comprising a peripheral frame, substantially parallel spaced apart outside and inside translucent panes mounted to the frame, a light control assembly mounted between the panes, the light control assembly comprising:

an upper section, the upper section including a first plurality of substantially horizontally-extending, vertically-spaced slats;

a lower section located vertically below the upper section, the lower section including a second plurality of substantially horizontally-extending, vertically-spaced slats, each slat of the second plurality of slats being adapted to pivot together with the other slats of the second plurality of slats along a horizontal axis of the slat between an open position and a closed position independently of the first plurality of slats, a substantial portion of light incident on the outside pane adjacent to the lower section passing through the inside pane when each slat of the second plurality of slats is in the open position, and a substantial majority of the light incident on the outside pane adjacent the lower section being inhibited from passing through the inside pane when each slat of the second plurality of slats is in the closed position; and an elongate horizontally-extending intermediate bar, the intermediate bar being (i) non-pivotal, and (ii) vertically-positioned in between the upper and lower sections with the lower section being suspended from the intermediate bar.

2. The window of claim 1, further comprising a first adjustment mechanism for selectively pivoting the second plurality of slats between the open and closed positions.

3. The window of claim 2, wherein the first adjustment mechanism includes an electric motor, the electric motor being attached to the peripheral frame substantially adjacent to the intermediate bar.

4. The window of claim 2, wherein the first adjustment mechanism includes an electric motor, the electric motor being mounted on the intermediate bar.

5. The window of claim 2, further comprising a second adjustment mechanism for pivoting each slat of the first plurality of slats along a horizontal axis of the slat between an open position and a closed position independently of the second plurality of slats, a substantial portion of the light incident on the outside pane adjacent to the upper section passing through the inside pane when each slat of the first plurality of slats is in the open position, and a substantial majority of the light incident on the outside pane adjacent the upper section being inhibited from passing through the inside pane when each slat of the first plurality of slats is in the closed position.

6. The window of claim 1, wherein the intermediate bar is attached to and suspended from opposite vertically-extending sides of the peripheral frame.

7. The window of claim 1, wherein one or more slats of the first plurality of slats has a transversely concave top surface.

8. The window of claim 7, wherein one or more slats of the second plurality of slats has a transversely convex top surface.

9. A substantially vertical, double-pane window comprising a peripheral frame, substantially parallel spaced apart outside and inside translucent panes mounted to the frame, a light control assembly mounted between the panes, the light control assembly comprising:

an upper section, the upper section including a first plurality of substantially horizontally-extending, vertically-spaced elongated slats, each slat of the first plurality of slats having (i) opposing substantially parallel, substantially horizontal elongated edges and (ii) a generally upwardly-facing top surface, the top surface having a concave transverse cross section that extends substantially from one elongated edge to the other elongated edge of the slat; and a lower section located vertically below the upper section, the lower section including a second plurality of substantially horizontally-extending, vertically-spaced slats, each slat of the second plurality of slats having (i) opposing substantially parallel, substantially horizontal elongated edges and (ii) a generally upwardly-facing top surface, the top surface having a convex transverse cross section that extends substantially from one elongated edge to the other elongated edge of the slat.

10. The window of claim 9, wherein each slat of the second plurality is adapted to pivot together with the other slats of the second plurality of slats along a horizontal axis of the slat between an open position and a closed position independently of the first plurality of slats, a substantial portion of light incident on the outside pane adjacent to the lower section passing through the inside pane when each slat of the second plurality of slats is in the open position, and a substantial majority of the light incident on the outside pane adjacent the lower section being inhibited from passing through the inside pane when each slat of the second plurality of slats is in the closed position.

11. The window of claim 10, further comprising a first adjustment mechanism for selectively pivoting the second plurality of slats between the open and closed positions.

12. The window of claim 11, further comprising a second adjustment mechanism for pivoting each slat of the first plurality of slats along a horizontal axis of the slat between an open position and a closed position independently of the second plurality of slats, a substantial portion of light incident on the outside pane adjacent to the upper section passing through the inside pane when each slat of the first plurality of slats is in open position, and a substantial majority of the light incident on the outside pane adjacent the upper section being inhibited from passing through the inside pane when each slat of the first plurality of slats is in the closed position.

13. The window of claim 9, wherein the top surfaces of the first plurality of slats are highly-reflective.

14. The window of claim 9, wherein the first plurality of slats are perforated.

15. The window of claim 9, further comprising an elongate horizontally-extending intermediate bar, the intermediate bar being vertically-positioned in between the upper and lower sections with the lower section being suspended from the intermediate bar.

16. The window of claim 15, wherein the intermediate bar is non-pivotal.

* * * * *